US006756554B1

(12) United States Patent
Hu

(10) Patent No.: US 6,756,554 B1
(45) Date of Patent: Jun. 29, 2004

(54) TACT SWITCH

(75) Inventor: Yong-Hui Hu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/426,823

(22) Filed: Apr. 29, 2003

(51) Int. Cl.[7] ..... H01H 5/18; H01H 3/42
(52) U.S. Cl. ..... 200/406; 200/533
(58) Field of Search ..... 200/406, 516, 200/533

(56) References Cited

U.S. PATENT DOCUMENTS 4,084,071 A * 4/1978 Smith ..... 200/516
6,018,132 A 1/2000 Chen
6,114,644 A * 9/2000 Nishikawa ..... 200/406
6,180,903 B1 1/2001 Chen
6,323,449 B1 11/2001 Janniere

FOREIGN PATENT DOCUMENTS

JP 25725900 4/1992

* cited by examiner

*Primary Examiner*—Renee Luebke
(74) *Attorney, Agent, or Firm*—Wei Te Chung

(57) ABSTRACT

A tact switch includes an insulative housing, a plurality of fixed contacts retained in the insulative housing, a movable contact, an actuator and a top cover. Each fixed contact portion exposed on the bottom wall of the insulative housing. The top cover is mounted on the housing and has an engaging plate projecting downwardly therefrom. The movable contact is positioned between the fixed contacts and the top cover and has a plurality of projections projecting therefrom. The actuator has an operating portion and a press portion slidably mounted between the top cover and the movable contact. In operation, when the operating portion is pressed inwardly, the movable contact elastically deforms such that the plurality of projections move downwardly to electrically contact with the plurality of contact portions.

5 Claims, 6 Drawing Sheets

TACT SWITCH

CROSS-REFERENCE TO RELATED APPLICATION

This application is a co-pending application of patent application Ser. No. 10/315,354 filed Dec. 9, 2002, entitled "METAL DOME TACT SWITCH", invented by Masao Okita and Fang-Jwn Liao, and assigned to the same assignee of the present invention.

BACKGROUND OF THE INVENTION

1. Field of the Invention

The present invention relates to a tact switch in which a plurality of separate contacts may be electrically connected together with a small transmission path via operation on the tact switch.

2. Description of Prior Art

Tact switches which quickly respond to a manual depression have been used in many appliances, such as in telephone sets, microwaves, remote controls, and TV sets. JP Pat. No. 2572590 discloses an electrical switch which includes a housing, a plurality of contacts retained in the housing; a metal dome lying over the plurality of contacts, an actuator arrangement and a cover with an oblique plate. The actuator arrangement includes a press section positioned between the cover and the metal dome and a manipulating section which extends to external side of the housing. In operation, when the manipulating section of the actuator arrangement is pressed by a user, the press section of the actuator arrangement moves forwardly and engages with the oblique plate, at the same time the oblique plate drives the press section downwardly to depress a middle portion of the metal dome so that the metal dome simultaneously electrically connects the plurality of contacts to each other. However, after a period of use, the metal dome can be elastically deformed through enough cycles that it will fail through metal fatigue, which makes the tact switch lose switch function. Moreover in the above prior art, a distance between the metal dome and the contacts is too large such that, in operation, the metal dome will be distorted to such an extent which results in a longer response time of the tact switch.

Hence, an improved tact switch is desired to overcome the disadvantages of the prior art.

BRIEF SUMMARY OF THE INVENTION

A main object of the present invention is to provide a tact switch providing a reliable electrical connection among a plurality of contacts.

Another object of the present invention is to provide a tact switch having a shortened response time.

A tact switch in accordance with the present invention comprises an insulative housing, a plurality of fixed contacts, a movable contact, an actuator and a top cover. The insulative housing has a bottom wall and peripheral walls extending upwardly from the bottom wall. The plurality of fixed contacts are retained in the bottom wall of the insulative housing. Each fixed contact has a contact portion exposed to an inner surface of the bottom wall of the insulative housing and a soldering portion soldered to a printed circuit board. The top cover is mounted on the housing and has an engaging plate projecting downwardly therefrom. The movable contact is positioned above the fixed contacts and has a plurality of projections projecting therefrom for engaging with the plurality of contact portions of the plurality of fixed contacts. The actuator having an operating portion extending to external side of the insulative housing and a press portion slideably mounted between the top cover and the movable contact.

In operation, when the actuator is pressed inwardly, the press portion of the actuator engages with the engaging plate, at the same time the engaging plate drives the press portion downwardly to depress the movable contact, which elastically deforms downwardly until the plurality of projections contact with the plurality of contact portions so that the movable contact simultaneously electrically connects the plurality of fixed contacts to each other, achieving an electrical connection between the plurality of fixed contacts. When the operating portion is released, the engaging plate urges the actuator to move outwardly from the housing and at the same time releases the moveable contact to make the plurality of projections out of electrical contact with the plurality of contact portions.

Other objects, advantages and novel features of the invention will become more apparent from the following detailed description of the present embodiment when taken in conjunction with the accompanying drawings.

DETAILED DESCRIPTION OF THE INVENTION

Figure 1:
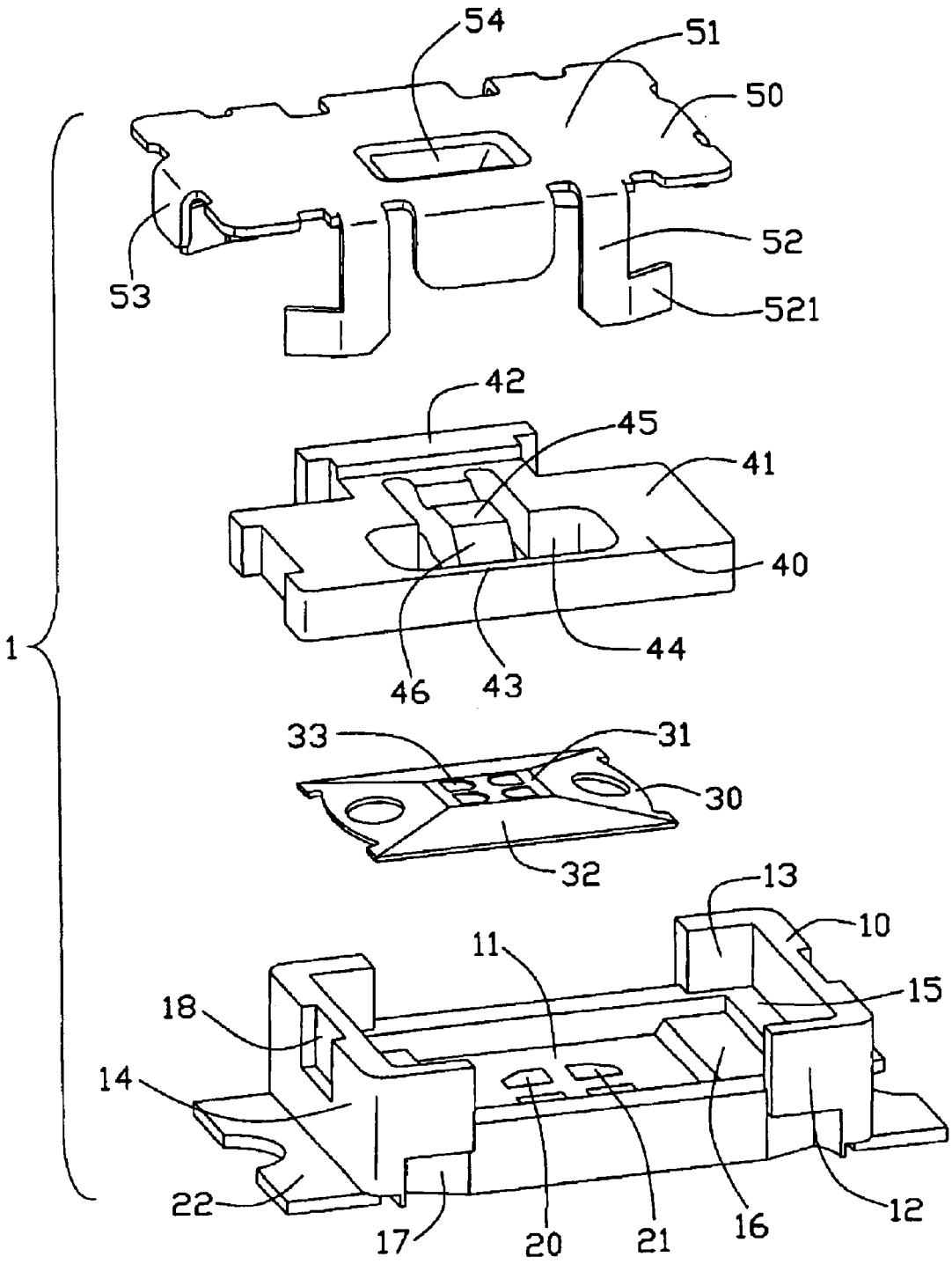
FIG. 1 is an exploded view of a tact switch in accordance with a first embodiment of the present invention.
Figure 2:
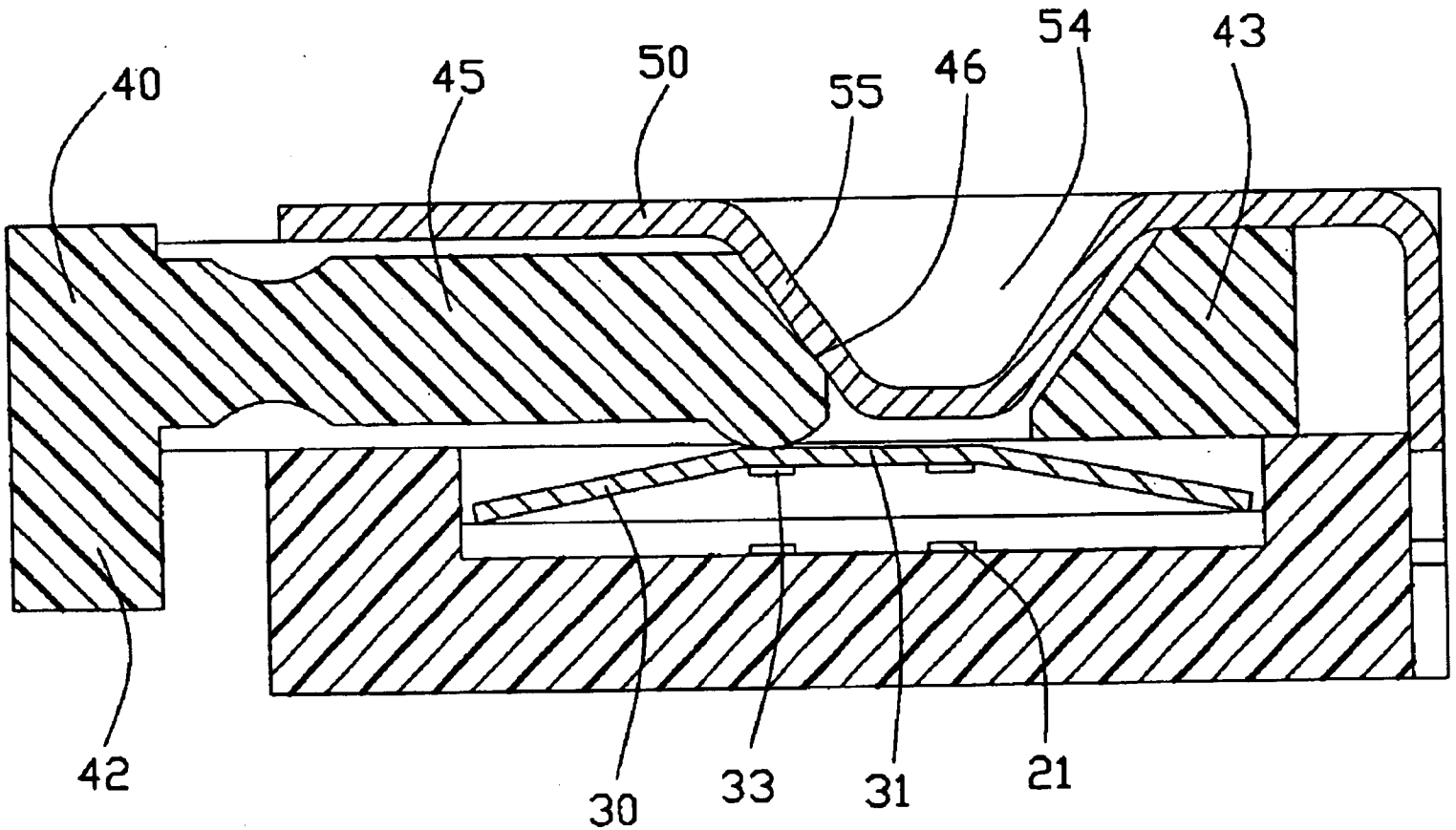
FIG. 2 is a schematic, cross-sectional view of the tact switch of the first embodiment of the present invention showing a movable contact not deformed.
Figure 3:
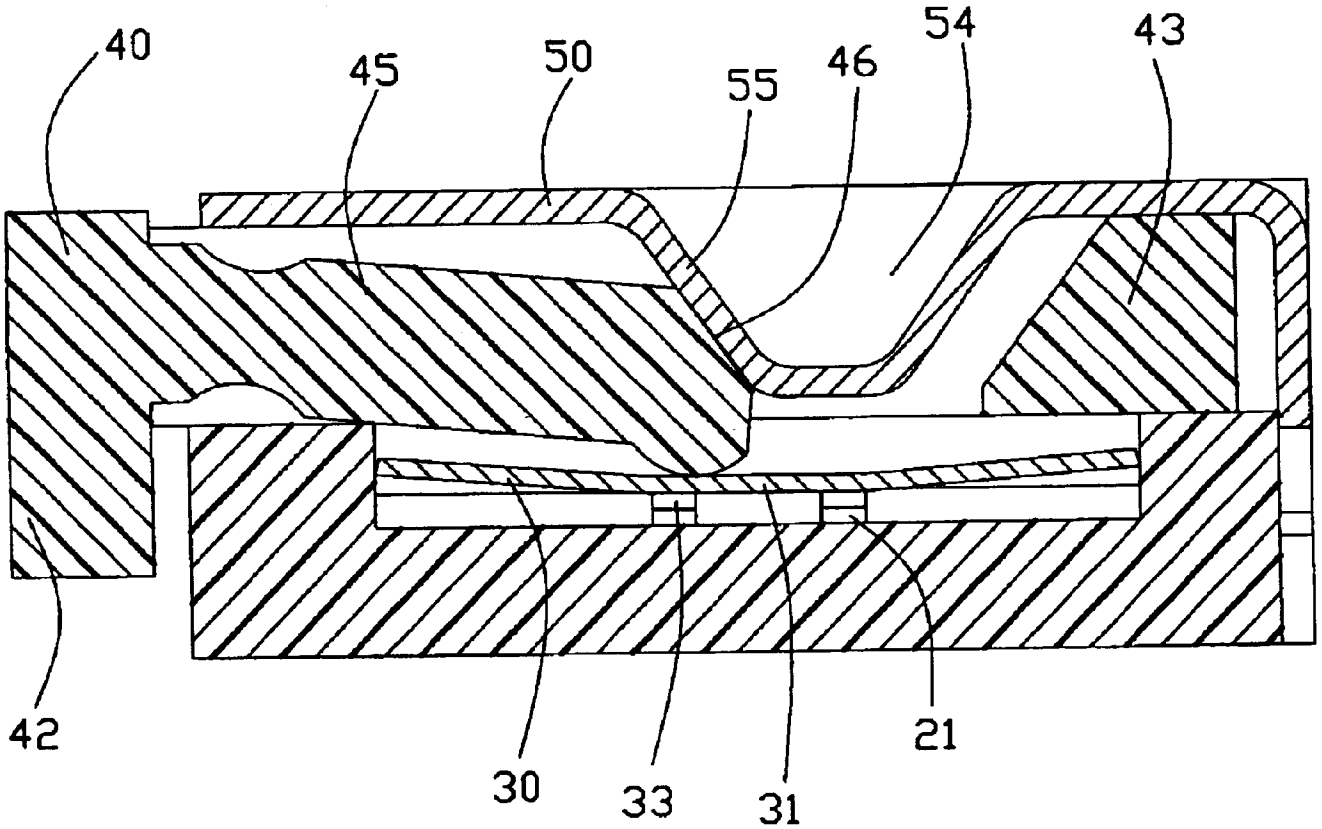
FIG. 3 is a schematic view showing the movable contact of FIG. 2 deformed.

Referring to FIGS. 1, 2 and 3, a tact switch 1 in accordance with a first embodiment of the present invention comprises an insulative housing 10, a plurality of fixed contacts 20 retained in the housing 10, a movable contact 30, an actuator 40 and a top cover 50.

The insulative housing 10 has a bottom wall 11, peripheral walls (not labeled) which extending upwardly from side edges (not labeled) of the bottom wall 11 and a cavity (not labeled) is defined therein. The peripheral walls include a front wall 12, a rear wall 13 and two opposite side walls 14. Two higher first steps 15 are respectively formed on two opposite sides of the bottom wall 11. Two lower second steps 16 are also respectively formed on the two opposite sides of the bottom wall 11, adjacent to the higher first steps 15. A front entrance (not labeled) and a rear entrance (not labeled) are respectively defined in middle portions of the front and rear walls 12, 13. Four first notches 17 are defined in outward sides of the front and rear walls 12, 13 adjacent to the two side walls 14. Two second notches 18 are defined in outward sides of the two side walls 14.

Each fixed contact 20 partially embedded in the insulative housing 10 by insert molding includes a contact portion 21 exposed to an inner surface of the bottom wall 11 and a solder portion 22 extending out of the insulative housing 10 for soldering to a printed circuit board of an electrical device (not shown).

The movable contact 30 has a rectangular central portion 31 and a declining portion 32 bent downwardly from the side edges of the central portion 31. The central portion 31 has a top surface (not labeled) and a bottom surface (not labeled). A plurality of projecting ends 33 are depressed downwardly from the top surface of the central portion 31 and project from the bottom surface of the central portion 31.

The actuator 40 has a plate-like body 41 and an operating portion 42 extending rearwardly from the plate-like body 41. The plate-like body 41 forms a guiding portion 43 at a front end thereof. A slot 44 is defined in the plate-like body 41. A press portion 45 projects forwardly from the operating portion 42 into the slot 44. An incline surface 46 is formed on a front end of the press portion 45.

The top cover 50 includes a rectangular plate 51 with a front edge (not labeled), a rear edge (not labeled) and a pair of side edges (not labeled). Four legs 52 extend downwardly from the front edge and the rear edge and two side tabs 53 extend downwardly from the two side edges for engaging with the second notches 18 of the insulative housing 10. Each leg 52 has a lateral extended portion 521 projecting sideways from a free end thereof for engaging with the corresponding first notch 17 of the insulative housing 10. A V-shape engaging plate 55 projects downwardly from the plate 51 for engaging with the incline surface 46 of the press portion 45 of the actuator 40 to thereby form a recess 54 in the plate 51.

In assembly, the movable contact 30 is positioned in the cavity of the insulative housing 10 with two opposite edges thereof disposed on the lower second steps 16 of the insulative housing 10 and the projecting ends 33 of the central portion 31 untouched with the contact portions 21 of the fixed contacts 20. The actuator 40 is assembled in the housing 10 with the operating portion 42 out of the rear entrance of the housing 10 and two opposite edges of the plate-like portion 41 disposed on the higher first steps 15 of the insulative housing 10. The top cover 50 is assembled onto the insulative housing 10, the lateral extended portions 521 of the legs 52 engage with the first notches 17 of the front and rear walls 12, 13, and the side tabs 53 of the top cover 50 engage with the second notches 18 of the side walls 14. The press portion 45 of the actuator 40 is positioned between the plate 51 and the central portion 31 of the movable contact 30, with the incline surface 46 abutting against the V-shape engaging plate 55 of the top cover 50.

In use, the operating portion 42 of the actuator 40 is pressed forwardly. The press portion 45 of the actuator 40 moves forwardly and engages with the engaging plate 55, driving the press portion 45 downwardly to depress the movable contact 30. The movable contact 30 has a flexible distortion to urge each projecting end 33 of the central portion 31 move downwardly to contact with each corresponding contact portion 21 so that the movable contact 30 simultaneously electrically connects the plurality of fixed contacts 20 to each other. When the operating portion 42 is released, a reverse operation occurs, wherein the engaging plate 55 presses against the press portion 45 of the actuator 40 and pushes the actuator 40 outwardly, which releases the movable contact 30 and allows the central portion 31 to recover upwardly, thus each projecting end 33 disconnects from each contact portion 21 of the fixed contact 20. Therefore, the tact switch 1 accomplishes switch function. Since each projecting end 33 of the movable contact 30 electrically connects each contact portion 21 of the fixed contact 20 within a very small distance, transmission distance is lessened which make the connection therebetween be reliable. Also, the lessened transmission distance of the tact switch 1 can decrease response time of the components.

Figure 4:
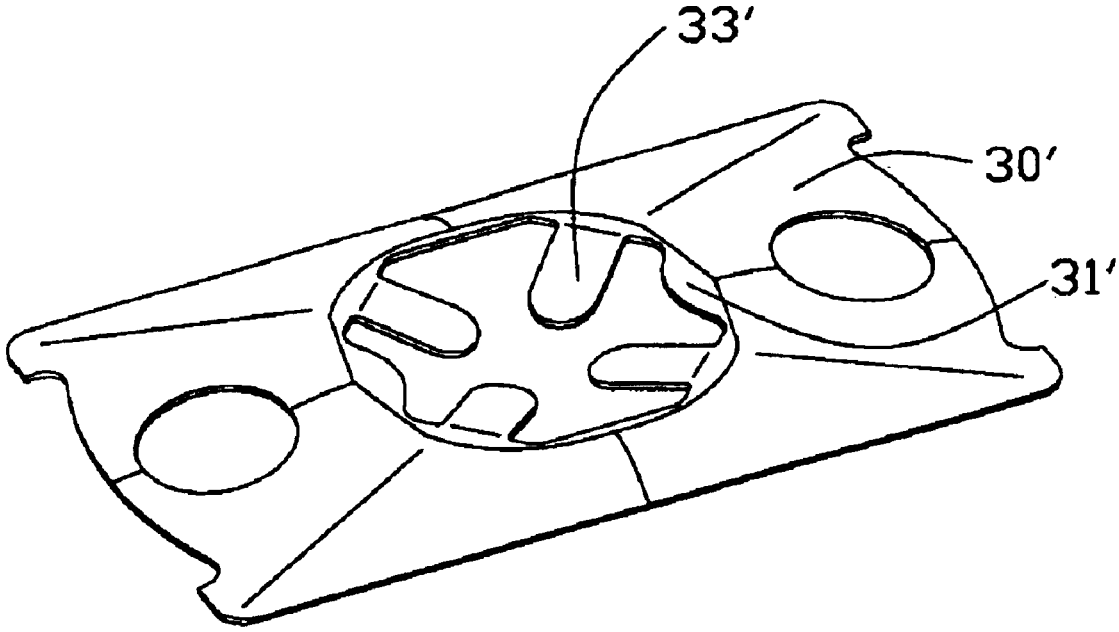
FIG. 4 is a perspective view of a movable contact of a tact switch of a second embodiment of the present invention.
Figure 5:
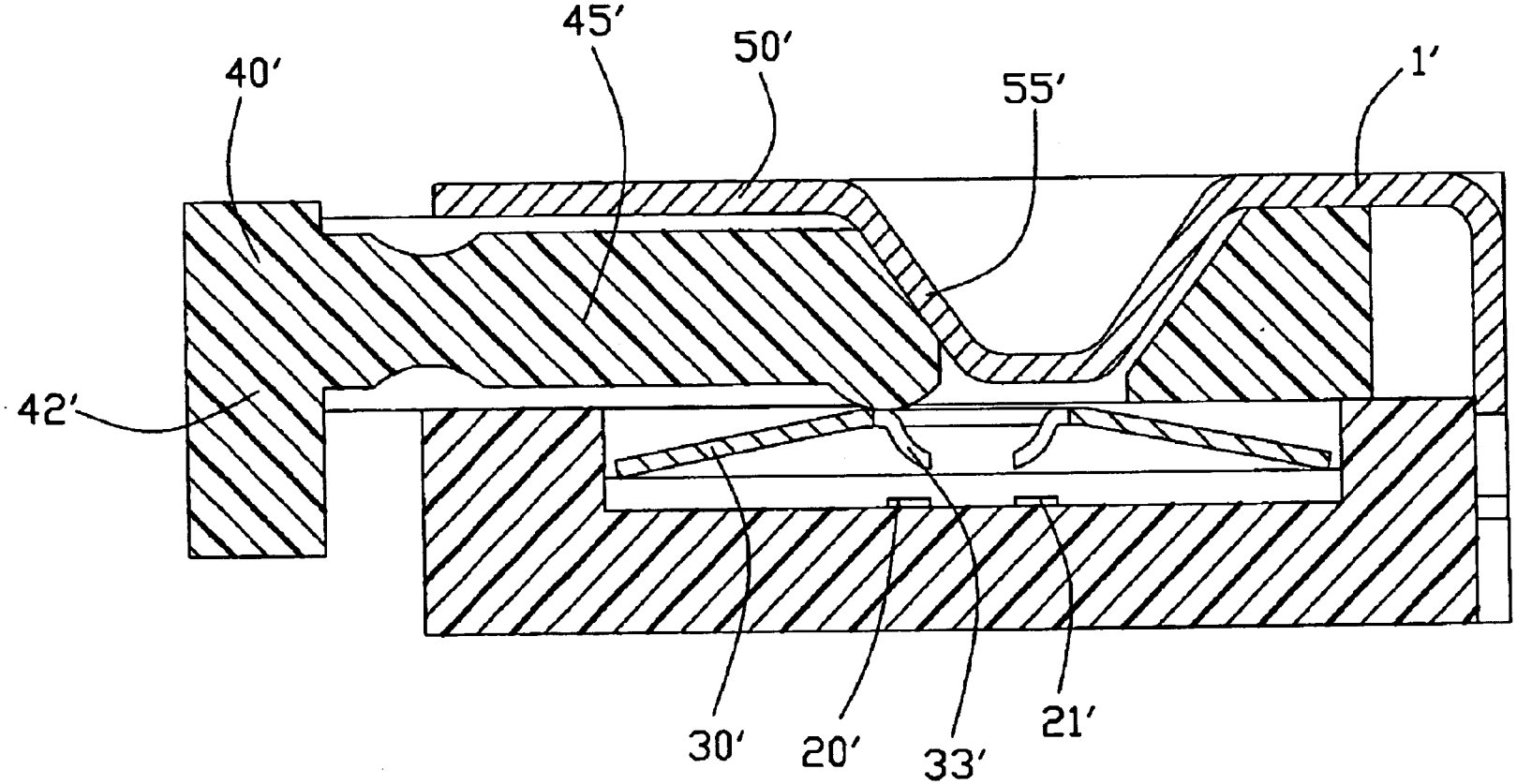
FIG. 5 is a schematic, cross-sectional view of the tact switch of the second embodiment of the present invention showing a movable contact not deformed.
Figure 6:
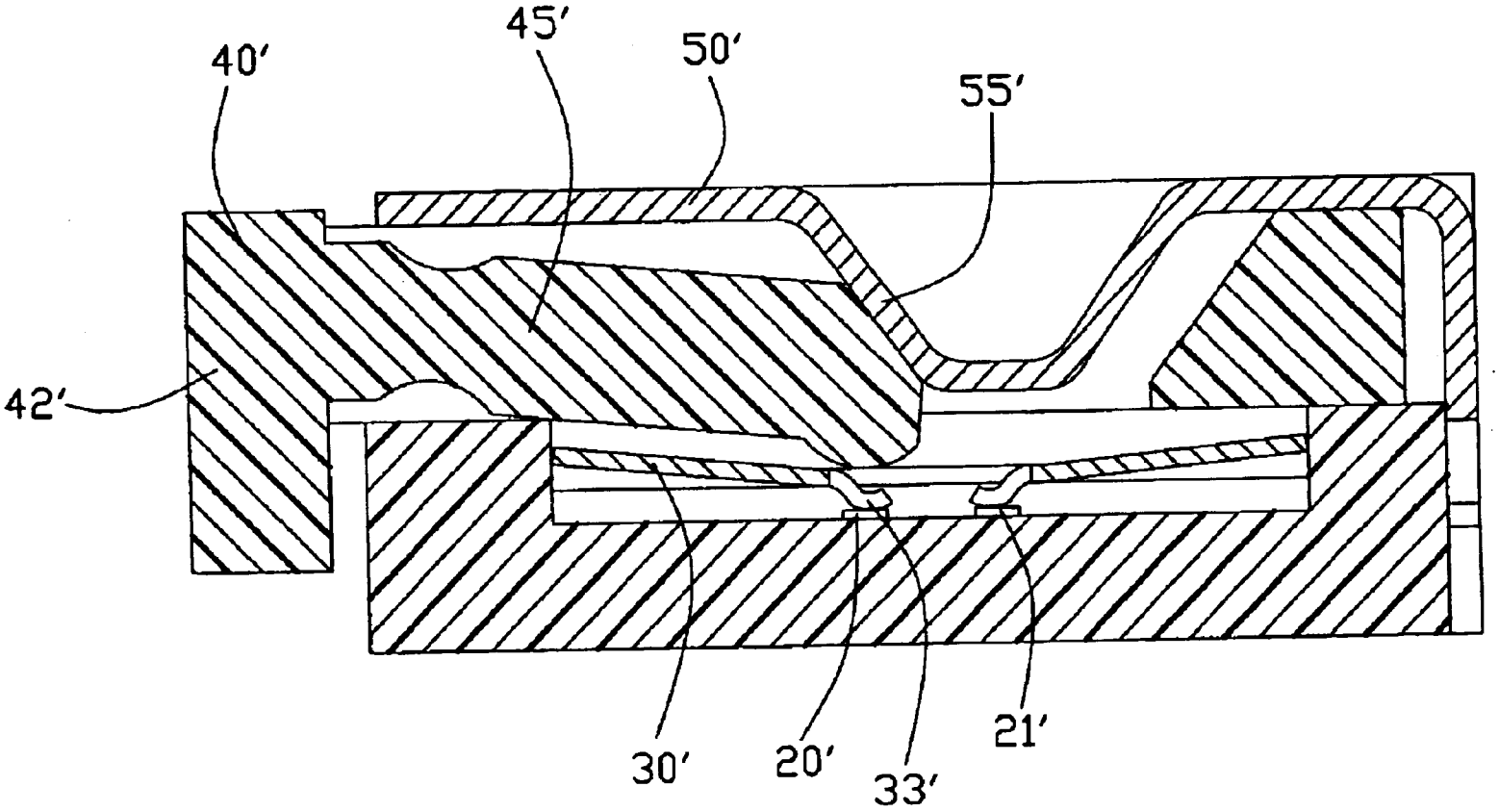
FIG. 6 is a schematic view showing the movable contact of FIG. 5 deformed.

FIGS. 4, 5 and 6 show a second embodiment of the present invention. FIG. 4 is a perspective view of a movable contact 30' of the second embodiment. The movable contact 30' has a central portion 31', which has a substantial circular shape and defines a circular opening (not labeled). The central portion 31' has a plurality of projecting tabs 33' projecting inwardly and downwardly from the peripheral edge of the opening.

FIGS. 5 and 6 are schematic view of the tact switch 1' of the second embodiment of the present invention. In use, the operating portion 42' of the actuator 40' is pressed. The press portion 45' of the actuator 40' moves forwardly and engages with the engaging plate 55', driving the press portion 45' downwardly to depress the movable contact 30'. The movable contact 30' has a flexible distortion to urge each projecting tab 33' of the central portion 31' move downwardly to contact with each corresponding contact portion 21' so that the movable contact 30' simultaneously electrically connects the plurality of fixed contacts 20' to each other. When the operating portion 42' is released, a reverse operation occurs, wherein the engaging plate 55' presses against the press portion 45' of the actuator 40' and pushes the actuator 40' outwardly, which releases the movable contact 30' and allows the central portion 31' to recover upwardly, thus each projecting tab 33 disconnects from each contact portion 21' of the fixed contact 20'. Therefore, the tact switch 1' accomplishes switch function.

It is to be understood, however, that even though numerous characteristics and advantages of the present invention have been set forth in the foregoing description, together with details of the structure and function of the invention, the disclosure is illustrative only, and changes may be made in details, especially in matters of shape, size, and arrangement of parts within the principles of the invention to fill extent indicated by the broad general meaning of the terms in which the appended claims are expressed.

What is claimed is:

1. A tact switch comprising:

an insulative housing having a bottom wall;

a plurality of fixed contacts retained in the insulative housing, each fixed contact having a contact portion exposed on the bottom wall of the insulative housing;

a top cover mounted onto a top surface of the housing and having an engaging plate projecting downwardly therefrom;

a movable contact positioned between the fixed contacts and the top cover, the movable contact having a central portion and a declining portion bent downwardly from side edges of the central portion, the central portion having a substantially circular shape and defining a circular opening, a plurality of projecting tabs projecting inwardly and downwardly from a peripheral edge of the opening and extending into the opening; and an actuator having a press portion slideably mounted between the top cover and the movable contact;

wherein when the actuator is pressed inwardly, the engaging plate drives the press portion downwardly to depress the movable contact, and the plurality of projecting tabs of the movable contact move downwardly to contact with the plurality of contact portions.

2. The tact switch as described in claim 1, wherein each contact portion of the fixed contact corresponds to each projecting tab of the movable contact.

3. The tact switch as described in claim 1, wherein the top cover has a rectangular plate, the engaging plate projects downwardly from the rectangular plate.

4. The tact switch as described in claim 1, wherein the plurality of projecting tabs are symmetrically defined and each projecting tab has a substantially rectangular shape.

5. A tact switch comprising:

an insulative housing defining a bottom wall;

a plurality of fixed contacts located in the housing with contact portions upwardly exposed on the bottom wall;

a conductive up and down deflectable contact located above the bottom wall and including a plurality of projections formed on an underside thereof and facing toward and vertically aligned with the corresponding fixed contacts, respectively; and an insulative actuator horizontally slidably moved in the housing above the deflectable contact; wherein said actuator includes an up and down deflectable pressing portion downwardly deflected, when said actuator is moved to an inner position relative to the housing, to press downwardly against the deflectable contact so as to have the projections mechanically and electrically engaged with the corresponding fixed contacts, respectively; wherein said actuator is downwardly deflected by a cover when said actuator is moved to the inner position, and said cover is attached to the housing to cooperate with the housing to define a space in which the actuator is received; wherein said cover includes a rectangular plate with a V-shaped engaging plate thereof, said V-shaped engaging plate integrally downwardly bulged from said rectangular plate and circumferentially linked to the rectangular plate without breaking and thus defining a complete upward recess therein, the actuator including a plate-like body defining a slot receiving the V-shaped engaging plate therein.

* * * * *